US006563764B2

(12) United States Patent
Terzian

(10) Patent No.: US 6,563,764 B2
(45) Date of Patent: May 13, 2003

(54) FACILITATED SETTING/RESETTING OF DIGITAL DATE DISPLAYS

(75) Inventor: Berj A. Terzian, Newbury, MA (US)

(73) Assignee: Equitime, Inc., Newbury, MA (US)

( * ) Notice: Subject to any disclaimer, the term of this patent is extended or adjusted under 35 U.S.C. 154(b) by 0 days.

(21) Appl. No.: 09/755,486

(22) Filed: Jan. 5, 2001

(65) Prior Publication Data

US 2002/0089897 A1 Jul. 11, 2002

(51) Int. Cl.[7] ..... G04B 19/24; G04C 17/00
(52) U.S. Cl. ..... 368/29; 345/33
(58) Field of Search ..... 368/76, 28–30, 368/34, 239, 242, 82, 79; 345/30, 33, 34, 38

(56) References Cited

U.S. PATENT DOCUMENTS

| | | | | | |
|---|---|---|---|---|---|
| 3,691,755 | A | * | 9/1972 | Girard | 368/29 |
| 3,971,012 | A | * | 7/1976 | Morokawa et al. | 368/29 |
| 4,092,638 | A | * | 5/1978 | Ripley | 368/30 |
| 4,184,319 | A | * | 1/1980 | Kumata | 368/29 |
| 4,291,307 | A | * | 9/1981 | Peelle et al. | 345/33 |
| 4,323,893 | A | * | 4/1982 | Ypsilantis et al. | 345/33 |
| 4,458,243 | A | * | 7/1984 | Sado et al. | 345/33 |
| 4,712,923 | A | * | 12/1987 | Martin | 368/29 |
| 4,794,390 | A | * | 12/1988 | Lippman | 345/33 |
| 4,932,756 | A | * | 6/1990 | Spicer | 349/142 |
| 5,323,143 | A | * | 6/1994 | Naradate et al. | 345/50 |
| 6,215,736 | B1 | * | 4/2001 | Terzian | 368/82 |
| 6,286,991 | B1 | * | 9/2001 | Terzian | 368/82 |

FOREIGN PATENT DOCUMENTS

| | | | | | |
|---|---|---|---|---|---|
| FR | 2572568 | A1 | * | 5/1986 | 345/33 |
| JP | 404142495 | A | * | 5/1992 | 368/76 |

* cited by examiner

*Primary Examiner*—Vit Miska
*Assistant Examiner*—Jeanne-Marguerite Goodwin
(74) *Attorney, Agent, or Firm*—Muserlian, Lucas and Mercanti

(57) ABSTRACT

Setting or resetting of digital dates in digital time displays is facilitated by providing an array of display elements which can be selectively activated to display the capital letters M, D and Y, together with simultaneously displayed digital values of months, days and years, respectively. This enables setting or resetting a digital time display to the corresponding correct current month, day and year, without confusion, uncertainty or ambiguity, even if identical, repeated date values are displayed during the setting or resetting process.

22 Claims, 1 Drawing Sheet

FACILITATED SETTING/RESETTING OF DIGITAL DATE DISPLAYS

BACKGROUND OF THE INVENTION

I. Field of the Invention

This invention relates to the setting or resetting of digital dates for months, days and years in digital time displays.

II. Description of the Prior Art

Digital wristwatches and other digital timepieces frequently include a display of the numerical date for each day of the month, often with an abbreviated name of each day as well. When power is interrupted to such displays, such as replacement of a depleted watch battery, or outages of line power, or cleaning or repair operations, many such displays revert to a default condition of all zeros, or to the month, day and year date when the calendar software was originally programmed into the timepiece. Therefore, after such interruptions, all dates have to be reset to the digital values of the prevailing month, day and year in order to synchronize the display with the current time.

In some products, particularly wristwatches, digital values of each month, day and year are displayed in the setting/resetting mode with a pair of digits which scroll through ranges of one through twelve for the months and one through thirty-one for the days, with or without non-significant zero digits in front of single digital values representing the first nine months and the first nine days, respectively. Similar scrolling through pairs of digits is used to display the values of years, beginning, for example, with 00 for the year 2000 and continuing up to 99 for the year 2099, given the recent advent of the second millennium.

III Recognition of Problems in the Prior Art

The above-described scrolling systems are subject to problems caused by the redundancy and repetition of identical digital values. For example, Jan. 1, 2001 conceivably could be represented by three repetitions of the value 01, thus requiring the user typically to remember the scrolling sequence, for example, first the month, then the day and finally the year, as is usually explained in the operating instructions, in order to understand what the displayed digital value represents. Similar redundancies are encountered between pairs of identical digital values representing months and days, months and years, and days and years. These problems are exacerbated by the fact that in some parts of the world, other scrolling sequences are used, such as the year, month and day, or the day, month and year. Therefore, there is a need for overcoming the above-described problems in order to facilitate and increase certainty in the setting or resetting of digital date displays.

SUMMARY OF THE INVENTION

The present invention provides a simple and effective solution to the above-described problems, achieved by a novel array of display elements that can be selectively activated to display the letters "M", "D" and "Y", standing for month, day and year, when each of such digital dates is being set or reset in a digital time display. As a result, the viewer is unambiguously informed of which specie of time value is being set or reset, even if identical digital values are displayed during the setting or resetting sequence. This eliminates the need to remember what particular sequence of values is presented by any specific timepiece during the setting/resetting mode, and enables the setting or resetting process to be confidently performed without any confusion, uncertainty or ambiguity.

DESCRIPTION OF THE PREFERRED EMBODIMENT

Referring again to FIG. 1, it illustrates three sets of digital display elements which can be selectively activated, electronically or electrically, to become visible in a digital time display, e.g. LCD, LED, fluorescent, incandescent or gaseous glow displays. The first array, at the left, comprises eight elements referenced by the lead lines labeled as "a"–"h" inclusive. Elements a, b, c and d can be activated to display a capital M, with elements b and c providing the internal V-shaped segment, and elements a and d the vertical outer segments, of that letter. The left element b of the b/c pair is preferably curved convexly upwardly for reasons explained below.

Elements a, b, e, f, g and h can be activated to display a capital letter D. Elements a, b, e and f form the closed perimeter, and elements g and h provide small leftward horizontal extensions of the top and the bottom, of that letter.

Elements b, c and e can be activated to display a capital letter Y, with elements b and c again providing the upper V-shaped segment, and element e the lower vertical base, of that letter.

Finally, there is a pair of 7-segmented digital display elements to the right of array a–h, referenced as composites by the brackets labeled as "i" and "j", respectively. Each of these 7-segmented arrays can be activated to display digital values from zero to nine in conventional manner.

Figure 1:
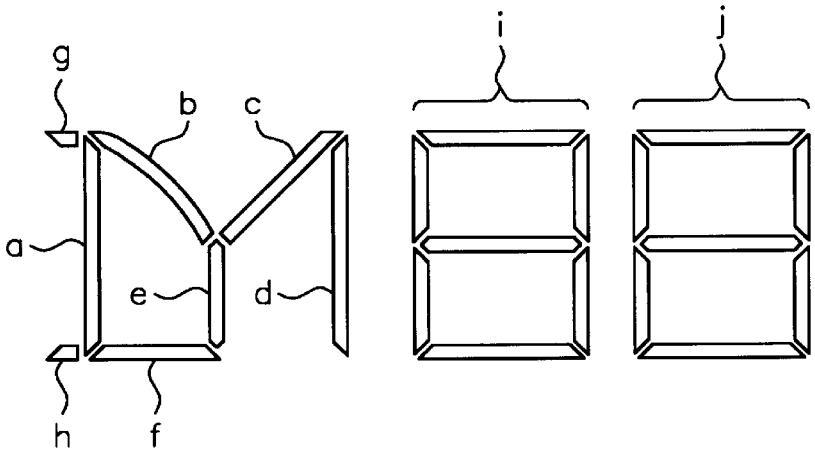
FIG. 1 illustrates a preferred embodiment of digital display elements arrayed in a manner which enables setting or resetting digital date values in accordance with the present invention.
Figure 2:
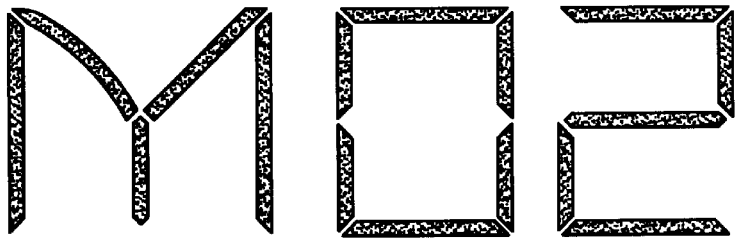
FIG. 2 is a similar view which illustrates activation of the FIG. 1 array to enable setting the date of a current month.

Referring now to FIG. 2, illustrated there is a selective activation of the arrays of FIG. 1 to display "M 02," which represents the fact that the display is synchronized with the second of the twelve months, i.e. February. Similarly, scrolling through all of the digital values of the twelve months, with the capital letter M remaining visible throughout the entire sequence, will inform the viewer that all such values are being presented for selection and setting or resetting to the appropriate month.

Figure 3:
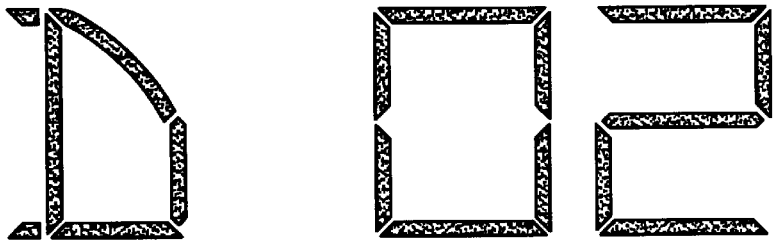
FIG. 3 is a similar view which illustrates activation of FIG. 1 to enable setting the date of a current day.

Next, FIG. 3 illustrates a selective activation of the FIG. 1 arrays to display "D 02," which represents the fact that the display is synchronized to the second day of the month. Here, the preferred curved shape of the element b, together with the horizontal extension elements g and h, assist the viewer to recognize that the resulting letter is a somewhat stylized capital letter D, standing for the day. Again, scrolling through all the values of the thirty one days, with the letter D remaining visible, will unambiguously inform the viewer that all such values are available for selection and setting or resetting to the appropriate day date.

Figure 4:
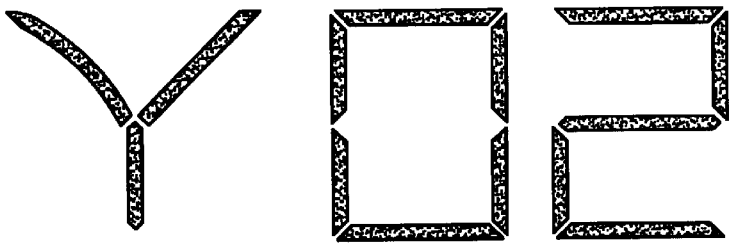
FIG. 4 is a similar view which illustrates activation of FIG. 1 to enable setting the date of a current year.

Finally, referring to FIG. 4, illustrated there is selective activation of the FIG. 1 array to display "Y 02," which represents the fact that the display is synchronized to the second year of second millennium, i.e. the year 2002. Depending on how far into the future the calendar software program is projected, scrolling through the sequence of all such values, again with the letter Y remaining visible, enables the viewer to readily select and set or reset the display to the applicable current year date. Thus, at the end of the process of setting or resetting the FIG. 1 array, in the exemplary manner of FIGS. 2–4, the viewer can confidently conclude that the process has been correctly and accurately performed no matter how many repeated identical digital values have been seen.

The invention has now been described in terms of its operating principles and a specific preferred embodiment. Many variations or modifications of the preferred embodiment will be evident to those skilled in the art. For example, the curvature of element b in FIG. 1 can be increased or decreased to suit individual preferences. Element c can be shaped in the straight linear manner shown in FIGS. 1 and 4 or it can be curved in analogous manner to element b, if desired. Alternatively, both elements b and c can be maintained as straight linear elements, although this may detract from recognition of the resulting letter in FIG. 3 as a capital D. Likewise, horizontal extensions g and h can be eliminated for the sake of fewer elements, but again at the risk of diminishing recognition of capital letter D in FIG. 3.

While the preferred embodiment is based upon the usual American sequence of setting the month, day and year in that order, other sequences practiced in Europe or elsewhere, such as the year, month and day, or the converse, day, month and year, can be equally enhanced by implementing the principles of the invention therein. Also, if a digital display is conventionally programmed to unambiguously display the year with all four digits, then the invention can be adopted to eliminate confusion or uncertainty between month and day date values displayed with only a pair of digits, as illustrated in FIGS. 1–3.

Furthermore, while the invention had been described with respect to the English initials M, D, Y, it is within the contemplation of the invention to use it with other languages, such as German, where Monat (month) is still M, but Tag (Day) becomes T and Jahre (year) becomes J. This will require rearrangement of the elements of FIG. 1, but such is certainly well within the skill of the art.

The invention can be incorporated in any digital timepiece which requires resynchronization of calendar digital dates, i.e. months, days and/or years, to the present time, whenever its operation is interrupted or otherwise disrupted out of synchronization. The invention is especially useful in combination with enhanced quadribalanced digital time displays, as described in U.S. Pat. No. 6,215,736, and with a single crown control for setting/resetting those displays, as described in U.S. Pat. No. 6,286,991.

In closing, it should be understood that the following claims are intended to cover all changes and modifications of the illustrative embodiments which fall within the literal scope of the claims and all equivalents thereof.

What is claimed is:

1. A display system for facilitating setting or resetting of digital dates comprising:

(a) means for displaying only a letter M together with means for displaying one or both of a pair of digits ranging in values from 1 to 12 to enable selection and setting or resetting the displayed digits to the value of a current mouth;

(b) means for displaying only a letter D together with means for displaying one or both of a pair of digits ranging in values from 1 to 31 to enable selection and setting or resetting the displayed digits to the value of a current day; and (c) means for displaying only a letter Y together with means for displaying a pair of digits ranging in values corresponding to the last two digits of post-2000 years to enable selection and setting or resetting the displayed digits to the value of a current year, said displays of (a), (b) and (c) being separately activated in a predetermined sequence, and said means for displaying the letters M, D and Y comprising a set of shared display elements such that said letters all appear in a single, substantially same position when activated in the predetermined sequence.

2. A system according to claim 1 in which the values of months, days and years are each displayed by a pair of 7-segmented digital display elements.

3. A system according to claim 1 which further comprises display means that are electronically or electrically activatable.

4. A system according to claim 1 in which each of the letters M, D and Y is maintained activated and visible as the corresponding range of displayed digits is scrolled for selection and setting or resetting.

5. A system according to claim 1 in which each of the displayed letters M, D and Y has substantially the same overall size as the displayed digital values thereof.

6. A display system for facilitating setting or resetting of digital dates comprising:

(a) two elements forming a V-shape pointed downwardly and having a vertex and right and left upper ends;

(b) three elements having lower ends extended downwardly from the upper ends and the vertex of the V-shaped elements;

(c) one element extended horizontally between the lower ends of the two elements extended downwardly from, respectively, the upper end of the left member and from the vertex of the V-shaped elements; and (d) means for displaying with the elements (a), (b) and (c) one or both of a pair of digits ranging in values:

(i) from 1 to 12; or (ii) from 1 to 31; or (iii) corresponding to the last two digits of post-2000 years;

whereby the V-shaped elements and the two elements extended downwardly from the upper ends of the V-shaped elements may be selectively activated to display only a letter M together with values of displayed digits (d) (i) to enable selection and setting or resetting the displayed digits to the value of a current month;

the left member of the V-shaped elements, the element extended downwardly from the upper end thereof, the element extended downwardly from the vertex of the V-shaped elements, and the element extended horizontally between the lower ends thereof may be selectively activated to display only a letter D together with values of displayed digits (d) (ii) to enable selection and setting or resetting the displayed digits to the value of a current day; and the V-shaped elements and the element extended downwardly from the vertex thereof may be selectively activated to display only a letter Y together with values of displayed digits (d) (iii) to enable selection and setting or resetting the displayed digits to the value of a current year;

said displays of d(i), (ii) and (iii) being separately activated in a predetermined sequence.

7. A system according to claim 6 in which the left member of the V-shaped elements is curved convexly upwardly to enhance recognition of the letter D when activated.

8. A system according to claim 6 which further comprises two relatively short additional elements extended leftward from the upper end of the left member of the V-shaped elements and from the bottom end of the element extended downwardly from the upper end of the left member of the V-shaped elements, which additional elements may be selectively activated to enhance recognition of the letter D when activated.

9. A system according to claim 6 wherein the values of displayed digits (d) (i) for months, displayed digits (d) (ii) for days, and displayed digits (d) (iii) for years are each displayed by a pair of 7-segmented digital display elements.

10. A system according to claim 6 in which each of the letters M, D and Y is maintained activated and visible as the corresponding range of displayed digits is scrolled for selection and setting or resetting.

11. A display system for facilitating setting or resetting of digital dates comprising:

(a) means for displaying only a letter which is the first letter of a word meaning month in a selected language together with means for displaying one or both of a pair of digits ranging in values from 1 to 12 to enable selection and setting or resetting the displayed digits to the value of a current month;

(b) means for displaying only a letter which is the first letter of a word meaning day in the selected language together with means for displaying one or both of a pair of digits ranging in values from 1 to 31 to enable selection and setting or resetting the displayed digits to the value of a current day; and (c) means for displaying only a letter which is the first letter of a word meaning year in the selected language together with means for displaying a pair of digits ranging in values corresponding to the last two digits of post-2000 years to enable selection and setting or resetting the displayed digits to the value of a current year;

said displays of (a), (b) and (c) being separately activated in a predetermined sequence, and said means for displaying said first letters comprising a set of shared display elements such that said letters all appear in a single, substantially same position when activated in the predetermined sequence.

12. A method according to claim 11 in which each of the letters in step (a), (b) and (c) is maintained activated and visible as the corresponding range of displayed digits is scrolled for selection and setting or resetting.

13. A system according to claim 11 in which each of said displayed first letters has substantially the same overall size as the displayed digital values thereof.

14. A method of facilitating setting or resetting of digital dates comprising:

(a) providing elements for, and displaying, only a letter M together with one or both of a pair of digits ranging in values from 1 to 12 to enable selection and setting or resetting the displayed digits to the value of a current month;

(b) providing elements for, and displaying, only a letter D together with one or both of a pair of digits ranging in values from 1 to 31 to enable selection and setting or resetting the displayed digits to the value of a current day; and (c) providing elements for, and displaying, only a letter Y together with a pair of digits ranging in values corresponding to the last two digits of post-2000 years to enable selection and setting or resetting the displayed digits to the value of a current year;

said displays of (a), (b) and (c) being separately activated in a predetermined sequence, and said elements comprising a set of shared display elements such that said letters M, D and Y all appear in a single, substantially same position when activated in the predetermined sequence.

15. A method according to claim 14 which further comprises displaying the values of months, days and years each with a pair of 7-segmented digital display elements.

16. A method according to claim 14 in which each of the letters M, D and Y is maintained activated and visible as the corresponding range of displayed digits is scrolled for selection and setting or resetting.

17. A method according to claim 14 which further comprises maintaining the overall size of the displayed letters M, D and Y substantially the same as the displayed digital values thereof.

18. A method of facilitating setting or resetting of digital dates comprising:

providing an array of display elements comprising:

(a) two elements formed in a V-shape pointed downwardly and having a vertex and right and left upper ends;

(b) three elements having lower ends extended downwardly from the upper ends and the vertex of the V-shaped elements; and (c) one element extended horizontally between the lower ends of the two elements extended downwardly from, respectively, the upper end of the left member and from the vertex of the V-shaped elements;

selectively activating the V-shaped elements and the two elements extended downwardly from the upper ends of the V-shaped elements to display only a letter M together with displaying one or both of a pair of digits ranging in values from 1 to 12 to enable selection and setting or resetting the displayed digits to the value of a current month;

selectively activating the left member of the V-shaped elements, the element extended downwardly from the upper end thereof, the element extended downwardly from the vertex of the V-shaped elements, and the element extended horizontally between the lower ends thereof, to display only a letter D together with displaying one or both of a pair of digits ranging in values between 1 and 31 to enable selection and setting or resetting the displayed digits to the value of a current day; and selectively activating the V-shaped elements and the element extended downwardly from the vertex thereof to display only a letter Y together with displaying a pair of digits ranging in values corresponding to the last two digits of post-2000 years to enable selection and setting or resetting the displayed digits to the value of a current year;

said displays of months, days and years being activated in a predetermined sequence.

19. A method according to claim 18 further comprising forming the left member of the V-shaped elements in a curve disposed convexly upwardly and activating the curved element to enhance recognition of the letter D when activated.

20. A method according to claim 18 further comprising providing two relatively short additional elements extended leftward from the upper end of the left member of the V-shaped elements and from the bottom end of the element extended downwardly from the upper end of the left member of the V-shaped elements, and activating such additional elements to enhance recognition of the letter D when activated.

21. A method according to claim 18 which further comprises displaying the values of months, days and years each with a pair of 7-segmented display elements.

22. A method according to claim 18 in which each of the letters M, D and Y is maintained activated and visible as the corresponding range of displayed digits is scrolled for selection and setting or resetting.

* * * * *